US005477722A

United States Patent [19]

Dziedzic et al.

[11] Patent Number: 5,477,722

[45] Date of Patent: * Dec. 26, 1995

[54] CAN TOOLING COMPONENTS

[75] Inventors: Chester J. Dziedzic, Littleton, Colo.; Andre Ezis, Vista, Calif.; Roblee L. Talbott, Golden, Colo.

[73] Assignee: Golden Technologies Company, Inc., Golden, Colo.

[ * ] Notice: The portion of the term of this patent subsequent to Mar. 14, 2012, has been disclaimed.

[21] Appl. No.: 403,471

[22] Filed: Mar. 13, 1995

Related U.S. Application Data

[63] Continuation of Ser. No. 940,617, Sep. 4, 1992, Pat. No. 5,396,788.

[51] Int. Cl.[6] ..... B21D 22/28

[52] U.S. Cl. ..... 72/347; 72/462

[58] Field of Search ..... 72/347, 349, 462, 72/467

[56] References Cited

U.S. PATENT DOCUMENTS

| | | | |
|---|---|---|---|
| 4,777,822 | 10/1988 | Uemura et al. | 72/366.2 |
| 5,095,730 | 3/1992 | Lauder | 72/347 |
| 5,396,788 | 3/1995 | Dziedzic et al. | 72/347 |

*Primary Examiner*—Lowell A. Larson
*Attorney, Agent, or Firm*—Sheridan Ross & McIntosh

[57] ABSTRACT

The present invention relates to improved materials for fabricating can bodies. In particular, the present invention relates to can tooling components fabricated from whisker-reinforced silicon nitride having from about 5 to about 15 weight percent whiskers with an average diameter of at least about 0.75 micrometers. The material preferably has a thermal expansion coefficient of less than about $3.5\times10^{-6}$ per °C. and a friction coefficient of from about 0.20 to about 0.24. The present invention also provides a method for reducing the trim height of can bodies formed using a can tooling apparatus.

12 Claims, 2 Drawing Sheets

CAN TOOLING COMPONENTS

This is a continuation of application Ser. No. 07/940,617, filed Sep. 4, 1992, now U.S. Pat. No. 5,396,788.

BACKGROUND OF THE INVENTION

1. Field of the Invention

The present invention is directed to improved can tooling components for the fabrication of metal containers, and in particular, whisker-reinforced silicon nitride can tooling components for the fabrication of drawn and ironed aluminum can bodies.

2. Description of Related Art

A two-piece aluminum beverage can has a top lid component and a body having an integrally formed closed end. The can is typically made by blanking circular disks from an aluminum sheet and forming a cup from the disk by placing the disk in a cup-forming die and moving a cup-forming punch through the cup-forming die. The cup is transferred to a body-forming apparatus where it is forced through a body-forming die by a body-forming punch. The body-forming die includes a successive plurality of rings known as the redraw and ironing rings. The clearance between the body-forming punch and the plurality of rings becomes progressively smaller as the cup moves through the die, so that the cup walls are "ironed" out into a thin section. A doming die then presses the bottom of the can body into a concave configuration for added strength.

After the can body is formed, the open end of the can is trimmed to the desired length. The can may then be washed, dried, and then necked on the open end. For cans that are to be printed with a label, the can may be transferred to a printer before necking. After printing, the can is dried in a drying oven.

A typical can body-forming apparatus is capable of producing about 240,000 cans per day based on 24-hour operation. Over 83 billion aluminum beverage cans are produced in the United States every year.

Because of the tremendous volume of aluminum beverage cans manufactured each year, any slight improvement in the efficiency of the manufacturing process can result in tremendous savings to the manufacturer. Over the years, for instance, the industry has made significant efforts to reduce the weight of the aluminum cans in order to reduce material costs. As a result, the weight of aluminum beverage cans has been significantly reduced with simultaneous improvements in strength, dimensional consistency, and quality of finish. However, further improvements are still sought.

The can tooling components, such as the body-forming punch, the redraw and ironing rings and the doming die, must be sufficiently strong and abrasion resistant to consistently produce acceptable cans. Traditionally, steel was used as the material for the body-forming punch. Recently, steel has been replaced in some applications by tungsten carbide (WC). However, tungsten carbide has a number of disadvantages. For example, tungsten carbide is extremely heavy, having a density of about 15 g/cm$^3$.

U.S. Pat. No. 5,095,730 by Lauder and issued on Mar. 17, 1992, discloses whisker-reinforced ceramic tools and components, specifically components used in the manufacture of two-piece aluminum beverage cans.

This patent discloses a variety of whisker-reinforced matrix materials, including alumina, silicon nitride, silicon carbide, zirconia, boron carbide and titanium diboride. This patent application also teaches that 2 to 40 weight percent of whiskers in the matrix are preferred, the whiskers having a diameter of from 0.35 to 0.65 micrometers. The application also states that whisker-reinforced alumina is the most preferred material for manufacturing two-piece body cans. It is disclosed that the whisker-reinforced materials impart certain advantages including reduced friction, reduced alumina formation on the formed cans, reduced scoring on the inside and outside of cans, longer useful service life of the tool components, lighter weight and ease of grinding.

However, most whisker-reinforced materials, including whisker-reinforced alumina, have a number of disadvantages,. particularly when used as a body-forming punch. For example, the surface of a punch fabricated from whisker-reinforced alumina having about ten volume percent silicon carbide whiskers rapidly shows evidence of surface fatigue and mechanical strength degradation when used to manufacture aluminum can bodies. Similar results are obtained with an alumina body-forming punch having about 15 volume percent silicon carbide whiskers. This surface fatigue significantly reduces the surface friction of the body-forming punch so that the punch is no longer able to form an acceptable can body. Further, the mechanical strength is degraded such that the strength is not high enough to prevent cracks from forming in the body-forming punch. Therefore, the punch is unable to produce an acceptable number of can bodies.

Further, the use of whisker-reinforced alumina and other materials that the present inventors are aware of requires that the can body be produced with a trim height variance. For example, the trim height on an aluminum can body is typically between about 0.094 inch and about 0.25 inch (2.4 mm to 6.4 mm). The trim height is the excess amount of aluminum remaining on the top of the can body after the can body is formed in the body-forming apparatus. The trim height results from an excess amount of aluminum intentionally put in the can body to account for deviations that occur in virgin aluminum can sheet thickness and can wall thickness, particularly when the body-forming apparatus is in the startup, or warmup, stage. During the startup stage, when the body-forming punch is cold, the punch has a smaller diameter than when the punch is warm and therefore does not iron the can body to its maximum height. After the punch has formed a number of can bodies, the punch warms and increases in diameter. The can bodies formed thereafter have a reduced can wall thickness and an excess of aluminum on the top edge as a result. The difference in trim height between the first cans and the subsequently produced cans is known as the trim height variation. The trim height variation must be accounted for since a punch apparatus can shut down and restart many times each day in a typical can-making operation.

If the trim height variation was substantially minimized or eliminated, the total volume of aluminum per can could advantageously be decreased. A reduction of the starting gauge of the aluminum by about 0.0001 inch (0.003 mm) will advantageously result in about $1 million per year savings for the typical aluminum can manufacturer who produces about 4.6 billion cans annually.

It would therefore be advantageous to provide a body-forming tool material that is less susceptible to thermal expansion, surface fatigue and failure than punch tools heretofore known. Further, it would be advantageous to provide a body-forming punch wherein the trim height variance on the aluminum cans due to thermal expansion of the punch is reduced or eliminated.

SUMMARY OF THE INVENTION

According to the present invention, a body-forming punch for a can tooling component comprises a whisker-reinforced silicon nitride material. The whiskers are silicon carbide and preferably have an average diameter of at least about 0.75 micrometers and comprise from about 5 to about 15 weight percent of the total composition. The composite material also preferably includes an amorphous intergranular phase formed from the reaction products produced from sintering aid additions. The intergranular phase can contain elements such as yttria, alumina, silicon, oxygen and/or nitrogen.

In one embodiment, the whisker-reinforced silicon nitride includes from about 2 to about 12 percent yttria and from about 0.5 to about 8 percent alumina. In a preferred embodiment, the whisker-reinforced silicon nitride includes from about 6 to about 8 weight percent yttria and from about 1 to 3 weight percent alumina.

The present invention also provides a process for producing an aluminum can body that includes the step of forcing an aluminum cup through a die with a body-forming punch having a thermal expansion coefficient of less than about $3.5\times10^{-6}$ per °C. and a coefficient of friction of from about 0.15 to about 0.35. This process enables can bodies to be produced with substantially no variation in trim height due to thermal expansion of the punch.

DETAILED DESCRIPTION OF PREFERRED EMBODIMENTS

Figure 1:
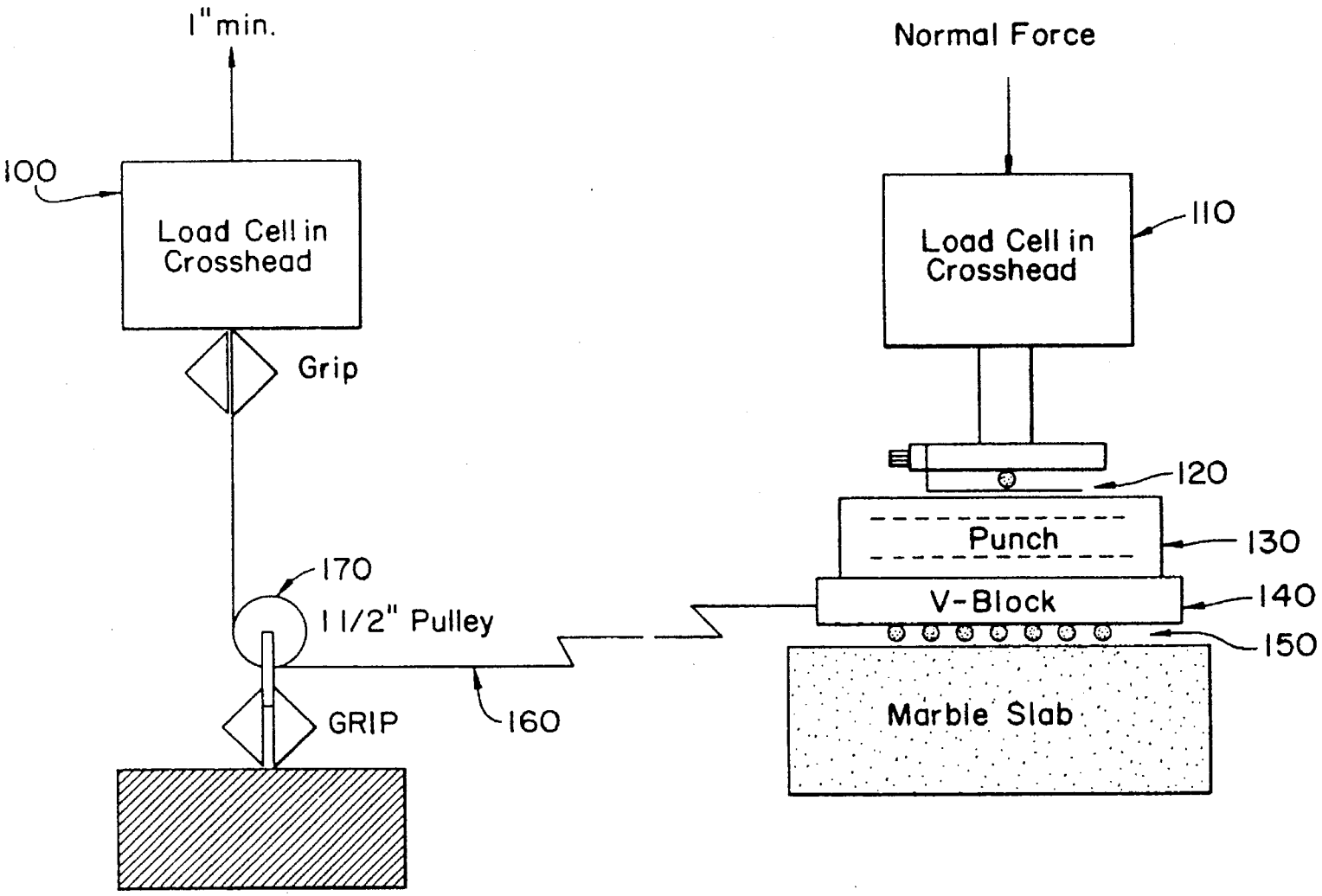
FIG. 1 illustrates an apparatus useful for measuring friction coefficients of can-tooling components according to the present invention.

The present invention is directed to improved can-tooling components, and in particular can-tooling components fabricated from certain whisker-reinforced silicon nitride ($Si_3N_4$) compositions having specific properties. As used herein, the term "whisker-reinforced silicon nitride" refers to a silicon nitride matrix that comprises whiskers dispersed therethrough. The silicon nitride matrix can include an intergranular phase formed by sintering additives, as is discussed hereinbelow.

According to the present invention, the silicon nitride matrix preferably contains a sufficient amount of whiskers to substantially prevent interaction of the can-tooling component with aluminum metal. That is, silicon nitride which does not contain a sufficient amount of whiskers will pick up aluminum metal on its surface after forming a number of aluminum can bodies. Aluminum metal on the surface of a body-forming punch will scratch the surfaces of subsequently produced can bodies. Whisker-reinforced silicon nitride advantageously reduces this problem, since whisker-reinforced silicon nitride does not have a tendency to pick up aluminum metal on its surface.

Utilizing silicon carbide whiskers advantageously results in interfacial bonding between the silicon nitride matrix and the whiskers, leading to improved strength and toughness. When silicon carbide whiskers are utilized, the whisker-reinforced silicon nitride preferably comprises from about 5 to about 15 weight percent whiskers, more preferably about 10 weight percent whiskers.

The whiskers utilized according to the present invention are preferably silicon carbide (SiC) single crystal whiskers. The whiskers preferably have an average diameter of at least about 0.75 micrometers and more preferably from about 0.75 to about 1.5 micrometers. Whiskers having diameters of about 0.75 micrometers or higher advantageously result in a composite having improved toughness over composites comprising smaller diameter whiskers. The whisker-reinforced silicon nitride composite also has improved surface characteristics, such as improved fatigue resistance. Therefore, the components will outlast components fabricated with smaller diameter whiskers. The aspect ratio of the whiskers is preferably from about 10 to about 30. The term "aspect ratio" refers to the length of the whisker divided by the mean diameter of the whisker.

The silicon nitride grains in the matrix material are preferably substantially beta-phase silicon nitride with an acicular morphology. The silicon nitride matrix may also comprise intergranular, or secondary, phases that are predominately the reaction products produced from sintering aid additions and silicon dioxide ($SiO_2$) that is intrinsic on the surface of the silicon nitride or silicon metal raw materials. These intergranular phases can be either crystalline or amorphous in nature and can contain elements of rare earths (e.g., yttrium), metal oxides (e.g., MgO, $ZrO_2$), aluminum, silicon, oxygen and nitrogen. In a preferred embodiment, the intergranular phase is substantially amorphous (non-crystalline). It has been found that can-tooling components formed from a silicon nitride matrix with an amorphous intergranular phase are less susceptible to surface fatigue during operation of the body-forming apparatus. Therefore, the coefficient of friction of the component surface advantageously remains substantially constant throughout use.

As discussed above, the silicon nitride matrix can include sintering aid additions. In one embodiment, the silicon nitride matrix includes from about 2 to about 12 weight percent rare earth oxide, preferably from about 6 to about 8 weight percent rare earth oxide. Preferably, the rare earth oxide is yttria ($Y_2O_3$). According to this embodiment, the matrix can also include from about 0.5 to about 8 weight percent alumina ($Al_2O_3$), and preferably includes from about 1 to about 3 weight percent alumina. The preferred amounts of rare earth oxide and alumina can advantageously form a substantially amorphous intergranular phase, as is discussed hereinabove.

Silicon dioxide can also be a constituent of the sintering aid composition. Silicon dioxide is an intrinsic compound typically associated with silicon metal and silicon nitride powders, and resides on the surface of the particles. The preferred amount of silicon dioxide according to the present invention is from about 0.75 to about 1.5 weight percent, however a range of from about 0.5 to about 3 weight percent silicon dioxide can be accommodated through compositional control.

Thus, can tooling components such as body-forming punches and redraw and ironing rings are fabricated from whisker-reinforced silicon nitride materials. The whisker-reinforced silicon nitride can be formed directly from silicon nitride powder or can be formed by nitriding silicon metal powder, resulting in a reaction bonded silicon nitride body.

When the can-tooling component is fabricated from silicon nitride powder, the silicon nitride powder can be mixed with the sintering aid constituents described above. The mixture is preferably comminuted and blended after being charged into an inert milling jar along with grinding media. The grinding media is selected such that any impurities introduced by the action of the media will be substantially non-detrimental to the properties of the material. Such media can include, but is not limited to, high-purity alumina and silicon nitride. The mixture is typically milled for about 48 hours and is then separated from the milling media using, for example, a mesh screen. Preferably, dry-milling is employed, but wet-milling can also be utilized. For example, a substantially unreactive liquid, such as isopropyl alcohol, can be added to promote homogenous mixing. The resultant slurry is then dried and gently milled to remove any large agglomerates.

Once the matrix-forming powders have been comminuted and homogenized to the desired state, the whisker component can then be introduced. The rheology of the whisker, and powder blend is controlled with known homogenizing techniques that are used to disperse the whiskers into the matrix powder.

The homogeneously mixed powder blend can then be compacted into the desired form. Organic binder systems to assist in the pressing and to increase the green strength of the compacts can be utilized without substantially affecting the properties of the sintered body. These organic binder systems are well-known to those skilled in the art. Preferably, the powder blend is pressed in the green state to a density of greater than about 50 percent of the theoretical density.

In one embodiment of the present invention, a measured quantity of the milled powder is loaded into a cold-press die arrangement and pressed at from about 65 MPa to about 130 Mpa, preferably about 100 MPa, to form a green body. Additionally, it is preferable to isostatically press the green body at a pressure of from about 90 MPa to about 110 MPa. The green density of the resultant compacted object is preferably at least about 60 percent of the theoretical density.

In one embodiment of the present invention, it is preferred to fabricate the body-forming punch so that the long axes of the whiskers are substantially parallel to the surface of the punch. This can be achieved, for example, by forming the powder blend into a plastic body and extruding the body through an extruder die to substantially align the whiskers near the surface of the punch blank. Isostatic pressing can also align the whiskers near the surface of the component. Isostatic pressing is a preferred forming method according to the present invention. By substantially aligning whiskers near the surface of the body, the area of whiskers exposed to the working surface of the can tooling component is advantageously maximized and the surface properties of the component are enhanced.

The green body is loaded into a suitable refractory container, such as one fabricated from graphite, after which a packing powder of similar composition to the pressed part can be added to the refractory container. The packing powder advantageously promotes a localized environment of similar composition to enhance densification of the product. Further, the silicon nitride composite product is preferably fired in an over-pressure furnace (e.g., about 200–3000 psi) to control decomposition of the material during sintering. Decomposition of silicon nitride typically begins at approximately 1870° C. under atmospheric conditions.

To sinter the green body, the furnace is preferably evacuated to a pressure of less than about 25 micrometers and is heated to about 750° C. Thereafter, argon, nitrogen or other mixed inert gases are vented into the furnace and the furnace temperature is raised from 750° C. to about 1650° C. at rate of from about 500° C. to about 750° C. per hour. The temperature of the furnace is then raised from about 1650° C. to about 1900° C. at about 250° C. per hour under an over-pressure of from about 200 to about 3000 psi (1.4 to 21 MPa). The soak time is preferably from about 1 to 8 hours, more preferably from about 1 to 3 hours. The component is then cooled at about 500° C. per hour with the gas pressure allowed to decay as the temperature decreases.

After sintering, hot isostatic pressing (HIP) can advantageously be used to eliminate substantially all pores over about 5 micrometers. For example, the component can be heated to about 1750° C. under a pressure of about 30,000 psi (207 MPa). If necessary, the sintered body can then be machined to the desired configuration for the can tooling component.

The can-tooling components fabricated from the whisker-reinforced silicon nitride according to the present invention have excellent surface properties that permit can-tooling components such as body-forming punches to operate for long periods of time without replacement or remachining. The surface of the component is not susceptible to surface fatigue and therefore the toughness and friction of the surface do not substantially deteriorate during use.

In addition, the thermal properties of the whisker-reinforced silicon nitride advantageously allow the trim height of the can body to be substantially stabilized when the material is used as the body-forming punch. By stabilizing the trim height the amount of aluminum used to produce the can body is reduced. For example, the thickness of the aluminum sheet can be reduced by about 0.0001 inches, resulting in a significant savings in raw material costs.

To achieve the stabilization of the trim height, the body-forming punch preferably has a thermal expansion coefficient of less than or equal to about $3.5\times10^{-6}$ per °C., more preferably from about $3.0\times10^{-6}$ per °C. to about $3.5\times10^{-6}$ per °C. This low thermal expansion coefficient substantially reduces the amount of expansion that occurs in the punch as the punch warms due to frictional forces.

This low thermal expansion also permits the gap between punch and the ironing die to be reduced. For example, when a carbide ironing ring is used with a whisker-reinforced silicon nitride punch, the inner diameter of the carbide ironing ring is about 2.4830 inches. When a carbide ironing ring is used with a carbide punch having the same diameter as the whisker-reinforced silicon nitride punch, the inner diameter of the ironing ring is 2.4835 inches. An inner diameter of 2.4840 inches is required when using a carbide ironing ring with a steel punch having the same diameter.

Further, it has been observed that the variation in the can wall thickness is substantially reduced when utilizing a body-forming punch according to the present invention. That is, the thickness of the can wall around the circumference of the can is substantially stable. This can also advantageously reduce the amount of aluminum needed to produce an acceptable can body.

The present inventors have also discovered that a preferred coefficient of friction between the punch material and aluminum metal is beneficial to the practice of the present invention.

The surface finish of the punch was measured with from about 10 to about 12 rms (root mean square) surface finish at the time of punch installation. According to coefficient of friction testing, the body-forming punch of the present invention preferably has a coefficient of friction of from about 0.15 to about 0.35, more preferably from about 0.20 to about 0.24.

The coefficient of friction was measured by an apparatus substantially as depicted in FIG. 1. Two universal testing machines having load cells 100 and 110 are utilized to apply a constant load to the device holding the aluminum can stock 120 to the punch material 130 and to apply and measure the forces required to overcome the resulting frictional forces between the aluminum can stock 120 and the can punch material 130. Both static and dynamic friction can be measured. The first universal testing machine 110 can be replaced by, for example, a 50-pound deadweight to obtain similar results. The force required to move the v-block 140 and punch 130 combination was applied at the arbitrary rate of 1.0 inch per minute.

Hardened steel rollers 150 provide a relatively friction-free surface for the v-block 140 and punch 130 combination to roll on. The moving crosshead 100 was connected to the v-block 140 via a flexible wire cable 160 reeved through a low-friction pulley 170. The precautions allow only the friction between the can stock 120 and the punch 130 to be measured.

The range for the coefficient of friction discussed above is preferable since it has been found that too much friction will prevent the formed aluminum can from being easily removed from the body-forming punch after being forced through the body-forming dies. The can is typically removed with a mechanical device which is air assisted, and therefore the friction should be low. However, a friction coefficient that is too low will lead to tear-offs of the can bodies, as is discussed hereinbelow.

The friction coefficient of, for example, whisker-reinforced alumina is similar to that of the whisker-reinforced silicon nitride of the present invention. The problem associated with whisker-reinforced alumina is that the surface of the composite changes rapidly during use as a can tooling component. As a result, the coefficient of friction of a whisker-reinforced alumina body-forming punch decreases as it is used to form aluminum cans, leading to tear-offs in a relatively short period of time. Comparatively, can tooling components made with the whisker-reinforced silicon nitride composite according to the present invention are capable of running for long periods of time without substantial change in the surface characteristics, particularly the coefficient of friction.

Further, the composites according to the present invention are much lighter than composites known heretofore. A body-forming punch formed from whisker-reinforced silicon nitride according to the present invention preferably weighs less than about 1.75 pounds and typically weighs about 1.6 pounds. Steel and whisker-reinforced alumina ceramic punches of similar design weigh about 4 pounds, and carbide punches typically weight 8 pounds or more. This reduction in weight advantageously reduces the dynamic loading on the body-forming apparatus. The reduced weight of the punch will reduce both the wear on the body maker and reduce set-up problems between the punch and the redraw dies and ironing dies. The lower weight will also advantageously reduce the ram whip, or deviation from the central axis of the body-forming apparatus. If the ram is whipping, the punch has an opportunity to contact the ironing dies, which in turn can destroy the surface of the punch and the surface of the ironing dies. Also, the alignment of the dies can be altered due to the pounding action of the ram and punch when the punch is too heavy. In addition to these advantages, it will be possible to design bodymakers that are capable of operating at higher speeds.

The composites according to the present invention also have an increased resistance to crack propagation over composite punches known heretofore. That is, due to the bonding between the silicon nitride and the silicon carbide whiskers, the resistance to crack propagation in the punch is greatly enhanced.

Figure 2:
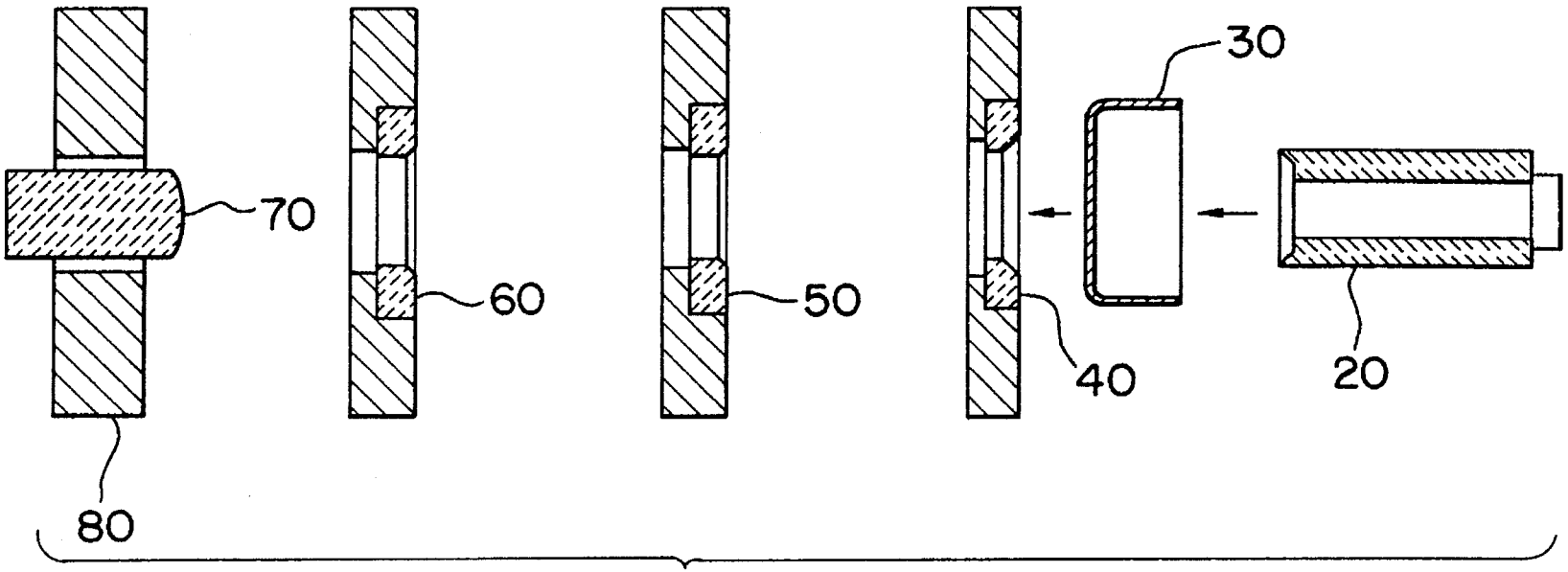
FIG. 2 illustrates a body-forming apparatus according to the present invention.

The operation of a can body tool apparatus according to the present invention will be described with reference to FIG. 2. A body-forming punch 20 is fabricated from a silicon nitride whisker-reinforced material as described hereinabove. A cup 30 is placed between the body-forming punch 20 and the redraw die 40. The body-forming punch forces the cup 30 through the redraw die 40 and subsequently through the first ironing die 50 and second ironing die 60. Some body-makers may also include a third ironing die. The travel of the body-forming punch 20 terminates on a doming die 70 and pressure ring 80 to form the bottom of the can body. The body-forming punch 20 then retreats back through the dies to begin another cycle.

To compare the punches fabricated according to the present invention with other known materials, particularly other whisker-reinforced composites, punches fabricated from alumina reinforced with 10 weight percent silicon carbide whiskers were fabricated. The punches had a surface finish of between about 12 micro-inches and about 16 micro-inches rms, as measured using a Federal Surfanalyzer 2000 profilometer (Federal Products Corp., Providence, R.I.) with a stylus having a tip radius of 0.0004 inches. A total of three whisker-reinforced alumina can body punches were tested on a can-making machine substantially as described. The ironing dies were fabricated from tungsten carbide.

All three punches ran into "tear-off" problems after approximately four hours of running (about 120,000 can bodies). A tear-off is the condition wherein the lower half of the can is separated from the upper half, the tear normally occurring in the upper one-third of the can. Once a tear begins, it progresses around the can radially. Tear-offs can result from a worn punch which has a reduced coefficient of friction or from small holes in the punch surface. Investigation determined that the surface of the whisker-reinforced alumina was changing due to fatigue of the punch surfaces. These punches are therefore unacceptable for full-scale production purposes.

A whisker-reinforced silicon nitride composite body-forming punch produced according to the present invention ran for a total of 12.6 million cans before it was removed due to tear-offs. The punch was fabricated from silicon nitride with 8 weight percent yttria and 1 weight percent alumina and comprised a substantially amorphous intergranular phase. The punch also included 10 weight percent silicon carbide whiskers having an average diameter of about 1.5 micrometers and an average length of about 30 micrometers.

The source of the tear-offs was found to be a small crack in the surface, caused by an impact on the surface. The size and surface finish of the punch was substantially unchanged from the initial measurements. There was no evidence of surface fatigue as was found in the whisker-reinforced alumina punch.

Another unexpected benefit of the process and punch of the present invention is that the trim height variation of the can is reduced or eliminated. To demonstrate this advantage, a standard steel punch was placed in a body-forming apparatus. Cups were formed from an aluminum alloy (AA 3004) sheet having a thickness of about 0.0112 inches. The body forming apparatus was started and cups were fed into the apparatus. The first 10 cans off of the apparatus had a trim height of from about 3/32 inch to about 4/32 inch on the top of the can body. After producing about 10 to 15 can bodies, the can bodies had a trim height of from about 10/32 inch to about 11/32 inch on the top of the can. This is due to the fact that the punch warmed and expanded, thereby ironing the can bodies to a greater degree. The excess trim height was removed in a trimming operation.

A punch fabricated from tungsten carbide was placed in the body-forming apparatus. Cups were punched from the aluminum alloy sheet (AA 3004) having a thickness of about 0.0112 inches. The body forming apparatus was started and cups were fed into the apparatus. The first three can bodies off the apparatus had a trim height of from about 3/32 inch to about 4/32 inch on the top of the can body. After producing about 10 to 15 can bodies, the can bodies had in excess of from about 6/32 inch to 7/32 inch on the top of the can body.

Similarly, a punch fabricated from whisker-reinforced alumina, having about 10 volume percent SiC whiskers, was placed in a body-forming apparatus. Cups were again punched from an aluminum alloy (AA 3004) sheet having a thickness of about 0.0112 inches. The body forming apparatus was started and cups were fed into the apparatus. The first three can bodies produced by the apparatus had an excess of from about 3/32 inch to about 4/32 inch on the top of the can body. After producing about 100 can bodies, the can bodies had an excess of from about 7/32 inch to about 8/32 inch on the top of the can. This is due to the fact that the punch warmed and expanded, thereby ironing the can bodies to a greater degree. The excess trim height is removed in a trimming operation.

A punch fabricated from whisker-reinforced silicon nitride according to the present invention was placed in a body-forming apparatus. The punch was fabricated from silicon nitride powder with 8 weight percent yttria and 1 weight percent alumina added as sintering aids and comprised a substantially amorphous intergranular phase. The punch also included 10 weight percent silicon carbide whiskers having an average diameter of about 1.5 micrometers and an average length of about 30 micrometers.

Cups were punched from an aluminum alloy (AA 3004) sheet having a thickness of about 0.0112 inches. The body forming apparatus was started and cups were fed into the apparatus. The first three can bodies off of the apparatus had an excess of from about 3/32 inch to about 4/32 inch on the top of the can body. After producing about 100 can bodies, the can bodies still had an excess of from about 3/32 inch to about 4/32 inch on the top of the can. This is due to the fact that the punch is very thermally stable and the expansion of the punch is matched or exceeded by the carbide ironing dies.

The reduction in trim height advantageously allows for the use of a smaller volume of aluminum per can produced and the elimination of the trim height variation. In one embodiment, the aluminum volume reduction per can is about 0.0107 cubic inches. (0.0076 inch×6/32 inch×2.4 inch×

What is claimed is:

1. A method for producing an aluminum can body, comprising the steps of:

(a) stamping a substantially circular disk from an aluminum sheet;

(b) forming a cup from said disk;

(c) forcing said cup through a body-forming die with a body-forming punch which comprises whisker-reinforced silicon nitride having a thermal expansion coefficient of less than about $3.5\times10^{-6}$ per °C. and a coefficient of friction of from about 0.15 to about 0.35.

2. A method as recited in claim 1, wherein said body-forming punch comprises whisker-reinforced silicon nitride having from about 5 to about 15 weight percent silicon carbide whiskers.

3. A method as recited in claim 1, wherein said whisker-reinforced silicon nitride comprises a second phase that is substantially amorphous.

4. A method as recited in claim 1, wherein said whisker-reinforced silicon nitride comprises:

(a) from about 5 weight percent to about 15 weight percent silicon carbide whiskers having an average diameter of from about 0.75 to about 1.5 micrometers and an aspect ratio from about 10 to about 30; and (b) a silicon nitride matrix comprising from about 2 weight percent to about 12 weight percent rare earth oxide and from about 0.5 weight percent to about 8 weight percent alumina, the remainder consisting essentially of silicon nitride.

5. A method as recited in claim 1, wherein said punch has a thermal expansion coefficient of from about $3.0\times10^{-6}$ to about $3.5\times10^{-6}$ per °C.

6. A method for producing an aluminum can body, comprising the steps of:

(a) stamping a substantially circular disk from an aluminum sheet;

(b) forming a cup from said disk; and (c) forcing said cup through a body-forming die with a body-forming punch having a thermal expansion coefficient of less than about $3.5\times10^{-6}$ per °C., a density of less than about 4 g/cc and a coefficient of friction of from about 0.15 to about 0.35.

7. A method as recited in claim 6, wherein said body-forming punch comprises whisker-reinforced silicon nitride.

8. A method as recited in claim 6, wherein said whisker-reinforced silicon nitride comprises a second phase that is substantially amorphous.

9. A body-forming punch for fabricating metal can bodies, wherein said punch comprises whisker-reinforced silicon nitride having a thermal expansion coefficient of less than about $3.5\times10^{-6}$ per °C. and a coefficient of friction of from about 0.15 to about 0.35.

10. A body-forming punch as recited in claim 9, wherein said body-forming punch comprises whisker-reinforced silicon nitride having a substantially amorphous second phase.

11. A body-forming punch as recited in claim 9, wherein said body-forming punch has a surface finish of between about 12 microinches and about 16 microinches RMS.

12. A body-forming punch as recited in claim 9, wherein said body-forming punch comprises whisker-reinforced silicon nitride having a substantially amorphous second phase and from about 5 to about 15 weight percent silicon carbide whiskers.

* * * * *